US006311580B1

(12) United States Patent
Nagy

(10) Patent No.: US 6,311,580 B1
(45) Date of Patent: Nov. 6, 2001

(54) FLIP TOP CAN OPENER

(76) Inventor: Louis Nagy, 8435 Clippert, Taylor, MI (US) 48180

( * ) Notice: Subject to any disclaimer, the term of this patent is extended or adjusted under 35 U.S.C. 154(b) by 0 days.

(21) Appl. No.: 09/293,035

(22) Filed: Apr. 16, 1999

(51) Int. Cl.[7] ..... B67B 7/16
(52) U.S. Cl. ..... 81/3.55; 81/3.09
(58) Field of Search ..... 81/3.09, 3.55, 81/3.56, 3.57, 23

(56) References Cited

U.S. PATENT DOCUMENTS

| | | | | |
|---|---|---|---|---|
| 461,688 | * | 10/1891 | Scott | 254/25 |
| 4,120,216 | * | 10/1978 | Goldberg | 81/3.57 |
| 4,253,352 | * | 3/1981 | O'Neal | 891/3.55 |
| 4,287,794 | * | 9/1981 | Kubach et al. | 81/3.31 |
| 4,412,464 | * | 11/1983 | Cook | 81/3.09 |
| 4,463,631 | * | 8/1984 | Barnes et al. | 81/3.09 |
| 4,563,919 | * | 1/1986 | Sellars | 81/3.55 |
| 5,277,083 | * | 1/1994 | Madonia | 81/3.09 |
| 5,911,794 | * | 6/1999 | Nordhoff | 81/3.55 |

FOREIGN PATENT DOCUMENTS

| | | | | |
|---|---|---|---|---|
| 2221668 | * | 2/1990 | (GB) | 81/3.55 |

* cited by examiner

*Primary Examiner*—Joseph J. Hail, III
*Assistant Examiner*—David B. Thomas
(74) *Attorney, Agent, or Firm*—Alfred F. Hoyle, Jr.

(57) ABSTRACT

A flip top can opener having a lift tab securing portion and a protruding force application member is provided. The lift tab securing portion is defined by an arcuate indentation formed at one end of the opener and having upper and lower projections and a central tab receiving region for engaging the tab mechanism of the flip top can. The force application member extends in a generally opposing direction and is spaced from the lift tab securing portion in accordance with the size of the tab mechanism, and can apply sufficient force to break open the seal of the can when the tab is engaged with the tab receiving region. The hook shaped portion and the force application member are connected to a lever arm, and the entire assembly is of unitary construction.

2 Claims, 2 Drawing Sheets

FLIP TOP CAN OPENER

BACKGROUND OF THE INVENTION

The present invention relates to a flip top can opener. More particularly, it relates to a tool for opening flip top cans which minimizes the effort required to open the cans.

STATEMENT OF THE PRIOR ART

Openers for pop top or flip top cans are well known in the art. In addition to implements designed specifically for opening flip top cans, it is known to use spoon or fork handles, or other similarly shaped metal instruments designed for other purposes. The reason for such widespread use of such makeshift flip top can openers is that many people have difficulty opening flip top cans with their hands. These people include the elderly, the very young, handicapped persons, persons with very long fingernails, or persons suffering from arthritis.

The prior art openers are generally relatively large or bulky, as they are typically used for more than one purpose, and suffer from several drawbacks. The openers usually require a fair amount of force. The prior art devices may also require a fairly long travel, that is, the users hand must travel a considerable distance along an arc in order to effect opening of the can. Furthermore, as these implements allow for more force to be applied to the lift tab of the flip top can than it was designed to handle, the implement may force the lift tab off of the can entirely, making the can extremely difficult to open. Also, the instrument, especially if it is designed for other purposes, may slip off of the top of the can resulting in injury to the user. Finally, the surface of the instrument may become marred from repeated use as a flip top can opener.

U.S. Pat. No. 4,864,898 issued to Tricinella discloses a combination pop top can and bottle opener. As with many of the prior art devices, it is relatively large, and has a plurality of gripping elements and fulcrum elements. The lift tab of the pop top can must be positioned between two elements which are spaced very close together. In addition to being much bulkier than the present invention, the close spacing of the gripping elements designed to hold the lift tab during use makes for difficult maneuvering for persons with unsteady hands who will have to "aim" the device carefully in order to effect use.

U.S. Pat. No. 4,617,842 issued to Yang discloses another combination opener device. This device while possibly effective for its stated purpose, does not have gripping elements for securely engaging the flip top can opening tab. This could lead to tab failure rates even higher than that associated with manual opening since more force can be generated with an implement than by hand.

U.S. Pat. No. 3,909,860 issued to Cantales discloses a combination can opener tool. Typical of prior art devices, it has numerous projections and grasping members, and is excessively large, complex, and unwieldy for performing any single task.

None of the above inventions and patents, taken either singly or in combination, is seen to describe the instant invention as claimed.

SUMMARY OF THE INVENTION

The present invention overcomes the disadvantages of the prior art by providing a flip top can opener having a lift tab securing portion and a protruding force application member. The lift tab securing portion is defined by an arcuate indentation formed at one end of the opener and having upper and lower projections and a central tab receiving region for engaging the tab mechanism of the flip top can. The force application member extends in a generally opposing direction and is spaced from the lift tab securing portion in accordance with the size of the tab mechanism, and can apply sufficient force to break open the seal of the can when the tab is engaged with the tab receiving region. The hook shaped portion and the force application member are connected to a lever arm, and the entire assembly is of unitary construction.

Accordingly, it is a principal object of the invention to provide a new and improved flip top can opener.

Accordingly, it is an object of the invention to provide a flip top can opener which minimizes the force required to open a flip top can.

It is another object of the invention to provide a flip top can opener which is reliable and inexpensive to manufacture.

It is another object of the invention to provide a flip top can opener which has no moving parts.

It is another object of the invention to provide a flip top can opener having a lift tab securing portion which is easily positioned.

Finally, it is a general object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION

Figure 2:
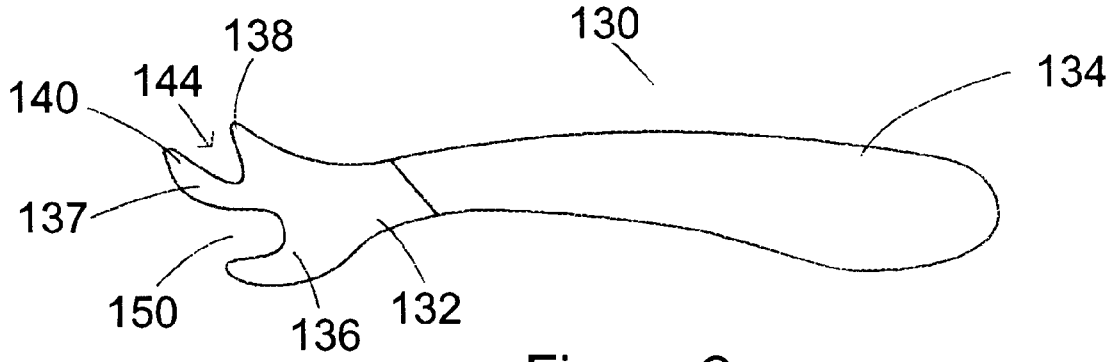
FIG. 2 shows a side view of a second embodiment of the flip top can opener of the present invention.
Figure 3:
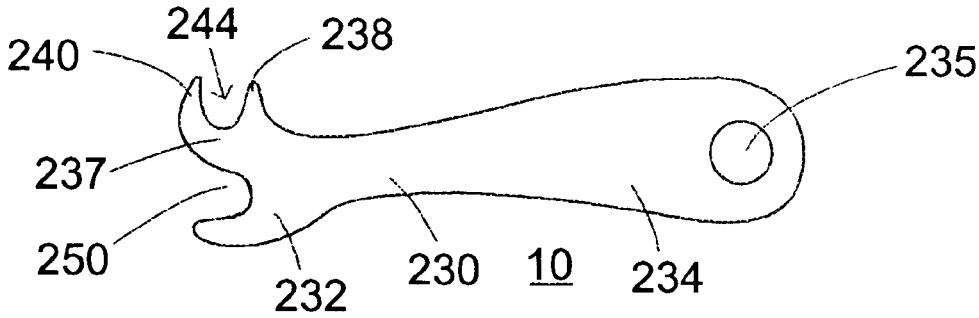
FIG. 3 shows a side view of a third embodiment of the flip top can opener of the present invention.
Figure 4:
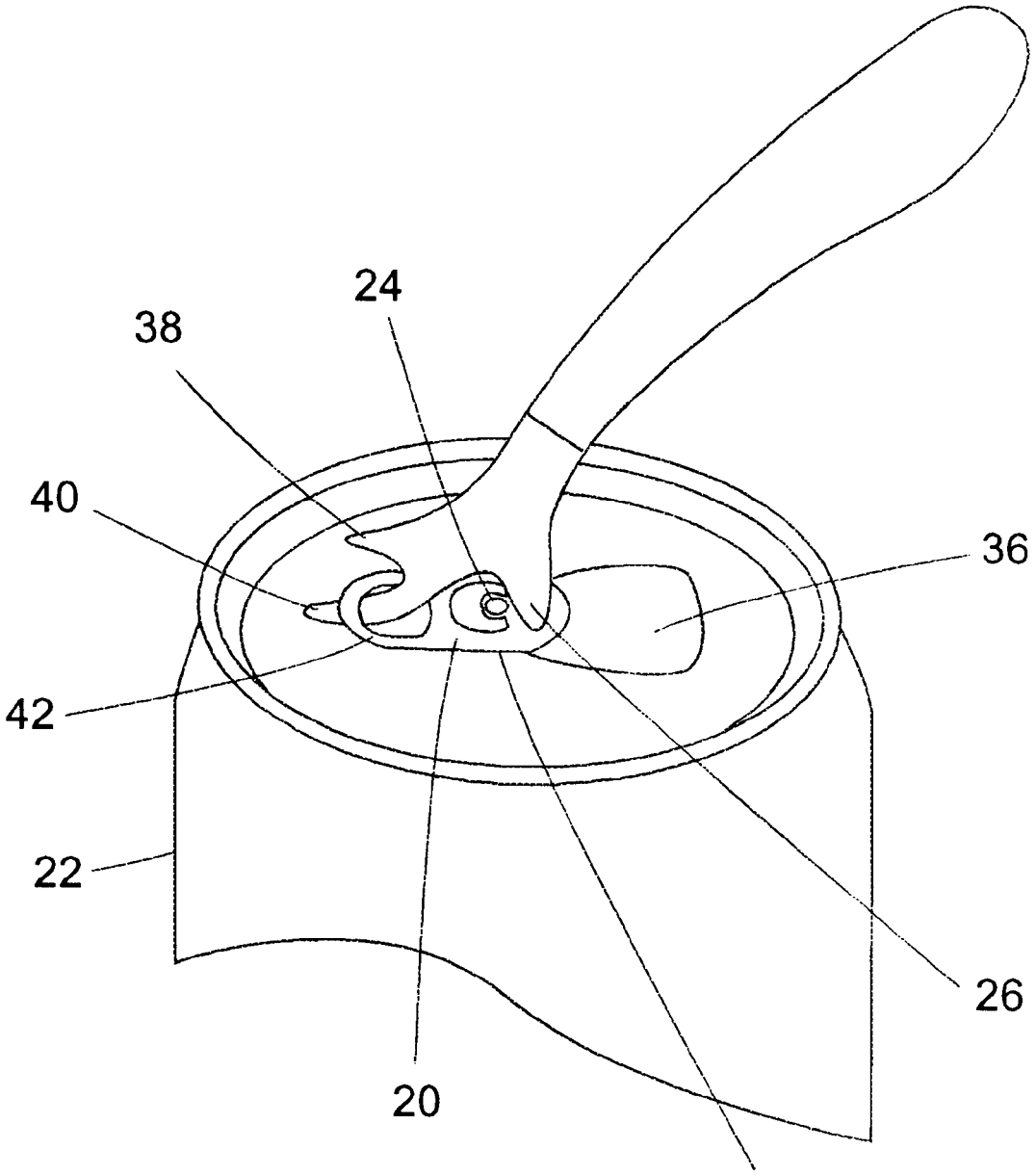
FIG. 4 shows a perspective view of the flip top can opener of the present invention illustrating the use of the opener in opening a flip top can.

Referring now to FIGS. 1–4, the flip top can opener of the present invention, generally indicated by the numeral 10, is shown. Modern flip top beverage cans utilize a lift tab 20 which is permanently secured to the top of the can 22 as shown in FIG. 4. In lifting the tab 20, an end of the tab depresses a section of the top of the can 22 which is scored on three sides. The end 23 of the tab 20 opposite the lifting end depresses the scored area 26 as it pivots about a rivet 24. Sufficient rotation of the lift tab 20 about the rivet 24 causes sufficient depression of the opposite end 23 of the tab 20 into the scored area 26 to form an opening in the top of the can 22. Typically, once the can 22 has been opened, the lift tab 20 is pressed back flat against the top of the can 22 allowing the contents thereof to be poured as desired. As has been previously mentioned, manual opening of these flip top cans poses some difficulty for certain users.

The opener 10 of the present invention has a main body 30, 130, 230 comprising essentially an elongated lever with the elongated structure having a lift tab securing portion 32, 132, 232 at one end and a handle portion 34, 134, 234 at the opposite end. The handle portion 34, 134, 234 may have an eye 235 for securing a key ring (not shown) to assist in maintaining the opener 10 easily accessible for the user. In the embodiment shown in FIG. 1, the handle portion 34 is bent to reduce the overall length of the main body 30. The contoured profile of the embodiment shown in FIG. 1 also provides an easier grip for persons with exceptionally small or weak hands. The lift tab securing portion 32, 132, 232 includes a protruding force application element 36, 136, 236 extending generally in the opposite direction from a tab engaging portion 37, 137, 237. The tab engaging portion 37, 137, 237 is defined by an arcuate indentation 39, 139, 239 terminating at either end by protruding tips 38, 138, 238, 40, 140, 240. The upper protruding tip 40, 140, 240 is relatively elongated and may be slid under the lift tab 20 as will be explained in more detail later. The lower protruding tip 38, 138, 238 serves to contain the lift tab 20 during force application to prevent disengagement thereof The tab engaging portion 37, 137, 237 serves to snugly engage the ring portion 42 of the lift tab 20 within a central region 44, 144, 244 of the arcuate indentation 39, 139, 239.

Figure 1:
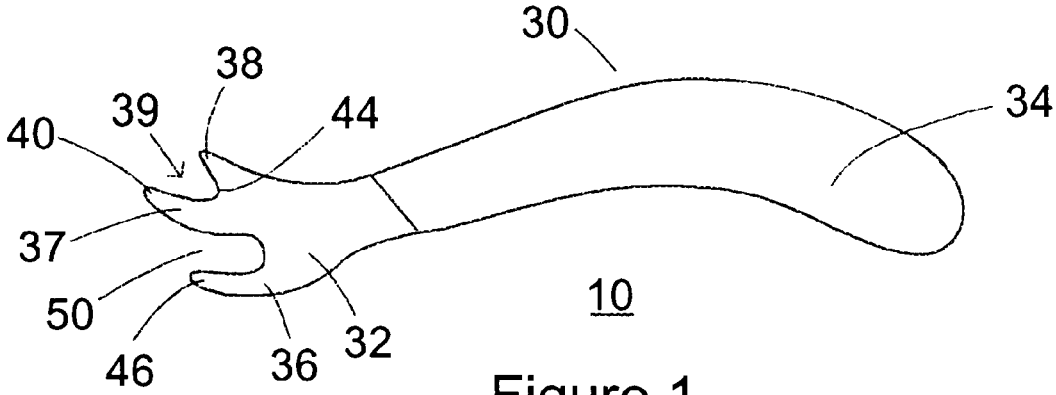
FIG. 1 shows a side view of a first embodiment of the flip top can opener of the present invention.

The force application element 36, 136, 236 is spaced apart from the central region 44, 144, 244 of the tab engaging portion 37, 137, 237 a distance which corresponds to the distance between the furthest edge of the ring portion 42 from the opposing end 23 of the lift tab 20. Preferably, the distance between the outer edge of the central region 44, 144, 244 of the tab engaging portion 37, 137, 237 and the tip 46, 146, 246 of the force application element 36, 136, 236 is about 16 to 20 mm. Maintaining this critical distance between the central region 44, 144, 244 of the tab engaging portion 37, 137, 237 and the tip 46, 146, 246 of the force application element 36, 136, 236 allows for some variation in the contours of the lift tab securing portion 32, 132, 232 as is shown in FIGS. 2 and 3. The variation shown in FIG. 3 allows for the shortest overall length resulting in a more compact opener 10 which the user may insert in a pocket or glove compartment. Referring again to FIG. 1, it should be noted that the central region 44, 144, 244 of the tab engaging portion 37, 137, 237 is arranged with respect to the tip 46, 146, 246 of the force application element 36, 136, 236 so as to define a straight line 50, 150, 250 parallel to the top of the can 22 when the opener 10 is snugly engaged with the lift tab 20. Accordingly, if the opener 10 is in position for opening the can 22, the main body 20 and handle 34, 134, 234 define an angle with the top of the can 22 which is exactly equal to the angle formed between line 50, 150, 250 and the main body 20. Thus it can be seen that in the embodiment of FIG. 2 that the opener 10 would be almost perpendicular to the top of the can 22 when snugly engaged with the lift tab, whereas the opener in FIG. 1 is at about a 70 degree angle with respect to the plane defined by the top of the can 22. Preferably the opener 10 is stamped from a metal such as brass having a thickness of about ¼ inch thick. Of course, nylon or other rigid material may be used.

In operation, the opener 10 of FIGS. 1–3 is positioned so that the upper protruding tip 40, 140, 240 is inserted under the lift tab 20 until the central region 44, 144, 244 abuts the ring 42 of the lift tab 20 as shown in FIG. 4. The user may then rotate the main body 30, 130, 230 of the opener 10 thereby causing rotation of the lift tab 20 about rivet 24. Rotation is continued until the tip 46, 146, 246 of the force application element 36, 136, 236 causes the end 23 of the lift tab 20 to press into the scored area 26 of the top of the can 22 thereby opening the can 22.

It can be readily appreciated that this action reduces the possibility of breaking the lift tab 20 off of the can 22 by reducing stress on the rivet 26. Because the tab engaging portion 37, 137, 237 snugly engages the lift tab 20, twisting thereof is essentially eliminated thereby effectively eliminating a common cause of lift tab failure. Also, because the user does not have to initially pry the lift tab 20 away from the top of the can 22, the fingernails of the user are not in jeopardy of being broken. Finally, because of the mechanical advantage achieved with the opener 10, children and other individuals with weak or diseased hands can effectively open the flip top can 22 with ease.

From the foregoing description, one skilled in the art can easily ascertain the essential characteristics of this invention and, without departing from the spirit and scope thereof, can make various changes and modifications of the invention to adapt it to various usages and conditions.

It is to be understood that the present invention is not limited to the sole embodiment described above, but encompasses any and all embodiments within the scope of the following claims:

What is claimed is:

1. A flip top can opener for opening a can having a lid including a scored closure adapted to be displaced from but not removed from said lid and having a lift tab secured to the lid, said lift tab having a predetermined thickness and secured to a top surface of said can by a rivet and including a ring at one end and a flat surface portion at the opposing end, comprising:

a lever body formed as a unitary elongated body;

a lift tab securing portion formed at one end of said elongated body, said lift tab securing portion having a tab engaging element and a force application member having a coplanar relationship and extending in generally opposing directions, said tab engaging element defined by an arcuate indentation terminating at either end by a pair of coplanar spaced protruding tips, said protruding tips spaced by a distance of at least several times the width of said lift tab, and including a central region for securing the lift tab ring;

said force application member spaced from said central region of said tab engaging element and having a single protruding tip for applying force to said flat surface portion of said lift tab;

a handle portion formed at an opposing end of said elongated body;

wherein said lift tab securing portion is generally flat and oriented in a vertical plane when force is applied to said lift tab, said force being applied in a direction parallel to said vertical plane and serving to cause displacement of said scored closure from said lid.

2. The opener of claim 1 wherein the spacing of said central region of said tab engaging element and the tip of said force application member is 16 to 20 mm.

* * * * *